US008011500B2

(12) United States Patent
Lee

(10) Patent No.: US 8,011,500 B2
(45) Date of Patent: Sep. 6, 2011

(54) REUSABLE BAG WITH FASTENING SYSTEM AND METHODS OF USE

(76) Inventor: Jae Sang Lee, Denver, CO (US)

( * ) Notice: Subject to any disclaimer, the term of this patent is extended or adjusted under 35 U.S.C. 154(b) by 263 days.

(21) Appl. No.: 12/400,712

(22) Filed: Mar. 9, 2009

(65) Prior Publication Data

US 2010/0226596 A1 Sep. 9, 2010

(51) Int. Cl.
*B65D 33/06* (2006.01)
*B65D 33/16* (2006.01)

(52) U.S. Cl. ..... 206/216; 206/554

(58) Field of Classification Search ..... 206/216, 206/581, 554, 823; 383/7, 8, 10, 61, 62, 383/68, 93, 95, 98, 99
See application file for complete search history.

(56) References Cited

U.S. PATENT DOCUMENTS

| | | | | |
|---|---|---|---|---|
| 4,960,208 | A * | 10/1990 | Tempke | 206/581 |
| 5,297,870 | A * | 3/1994 | Weldon | 383/59 |
| 6,595,687 | B2 * | 7/2003 | Godshaw et al. | 383/6 |
| 2004/0197032 | A1 * | 10/2004 | Clark | 383/104 |
| 2005/0150800 | A1 * | 7/2005 | Lown et al. | 206/427 |
| 2005/0285749 | A1 * | 12/2005 | Schmidt-Troschke et al. | 340/686.1 |
| 2007/0071366 | A1 * | 3/2007 | Kao | 383/38 |
| 2010/0084443 | A1 * | 4/2010 | Adelman | 224/153 |
| 2011/0142373 | A1 * | 6/2011 | Kong | 383/6 |

OTHER PUBLICATIONS

Website of competitive product: http://www.envirosax.com Printed pages of the competitive product website provided.
Website of competitive product: http://envirosax.com Printed pages of the competitive product website provided.

* cited by examiner

*Primary Examiner* — Jacob K Ackun
(74) *Attorney, Agent, or Firm* — Leyendecker & Lemire, LLC

(57) ABSTRACT

A reusable bag with a fastening system is disclosed. The reusable bag having at least one panel, but typically having a first panel and a second panel with a first loop handle and a second loop handle, the first and second handles coupled with and extending from the first and second panels respectively. The fastening system of the reusable bag comprises at least one of, but typically both a first strap and a second strap. The first strap having one of a hook material and a loop material, while the second strap having another of the hook material. Further disclosed are a looped third strap of the fastening system and a pocket adapted to receive the first and second straps. Methods relating to the reusable bag and fastening system, such as a method comprising folding and/or rolling, stacking, wrapping, and securing one or more reusable bags are additionally described herein.

16 Claims, 7 Drawing Sheets

REUSABLE BAG WITH FASTENING SYSTEM AND METHODS OF USE

FIELD OF THE INVENTION

The present invention relates generally to bags and other load carrying devices. More specifically, the present invention relates to reusable bags.

BACKGROUND

Reusable bags have become increasingly popular as individuals become more environmentally conscience. Reusable bags are commonly used in activities such as shopping and/or carrying books, papers, files, food, water, clothing, and a variety of other items too numerous to mention. Embracing reusable bags, particularly in the context of shopping, will result in less litter, less waste of resources, and reduced costs to retailers and end consumers. However, there are many deficiencies in the prior art that make both using and adopting reusable bags a challenge for many individuals.

In some applications, reusable bags serve as a replacement for traditional paper or plastic bags that consumer would receive a grocery or retail store. For practical use in such applications, it is beneficial for reusable bags to be comprised of thin materials or fabrics so that one or more reusable bags can easily be combined and carried into the store or a plurality of stores.

Various movements of the user of a reusable bag may likely cause heavy items in the reusable bag to undesirably shift to one side of the reusable bag or another. Given the lack of structural integrity of many reusable bags, such load shifting of the heavy items may unfortunately cause the items to fall out of the reusable bag. This load shifting problem is emphasized in middle to larger sized reusable bags with large openings adapted to receive and carry larger and heavier items. Bulky reusable bags made of cotton or thicker materials may address some of these needs as they may offer greater structural integrity in some instances. However, they fail to meet many other needs as they tend to be cumbersome and difficult to clean and care for.

The simplicity in design that in one sense is a necessity for reusable bags may also act as an encumbrance to its use in another sense. A plurality of pockets and compartments for storage of items of various sizes and shapes adds to the size of the reusable bags and cost and complexity of manufacturing thereof.

Heretofore there have been no reusable bags specifically designed to meet the needs of environmentally conscious individuals who do not wish to sacrifice style and functionality. Only a portion of the needs associated with reusable bags are met by the prior art. Accordingly, there is a need for a reusable bag that meets the needs of environmentally conscious individuals that overcomes the problems and challenges described herein.

DETAILED DESCRIPTION

Figure 1:
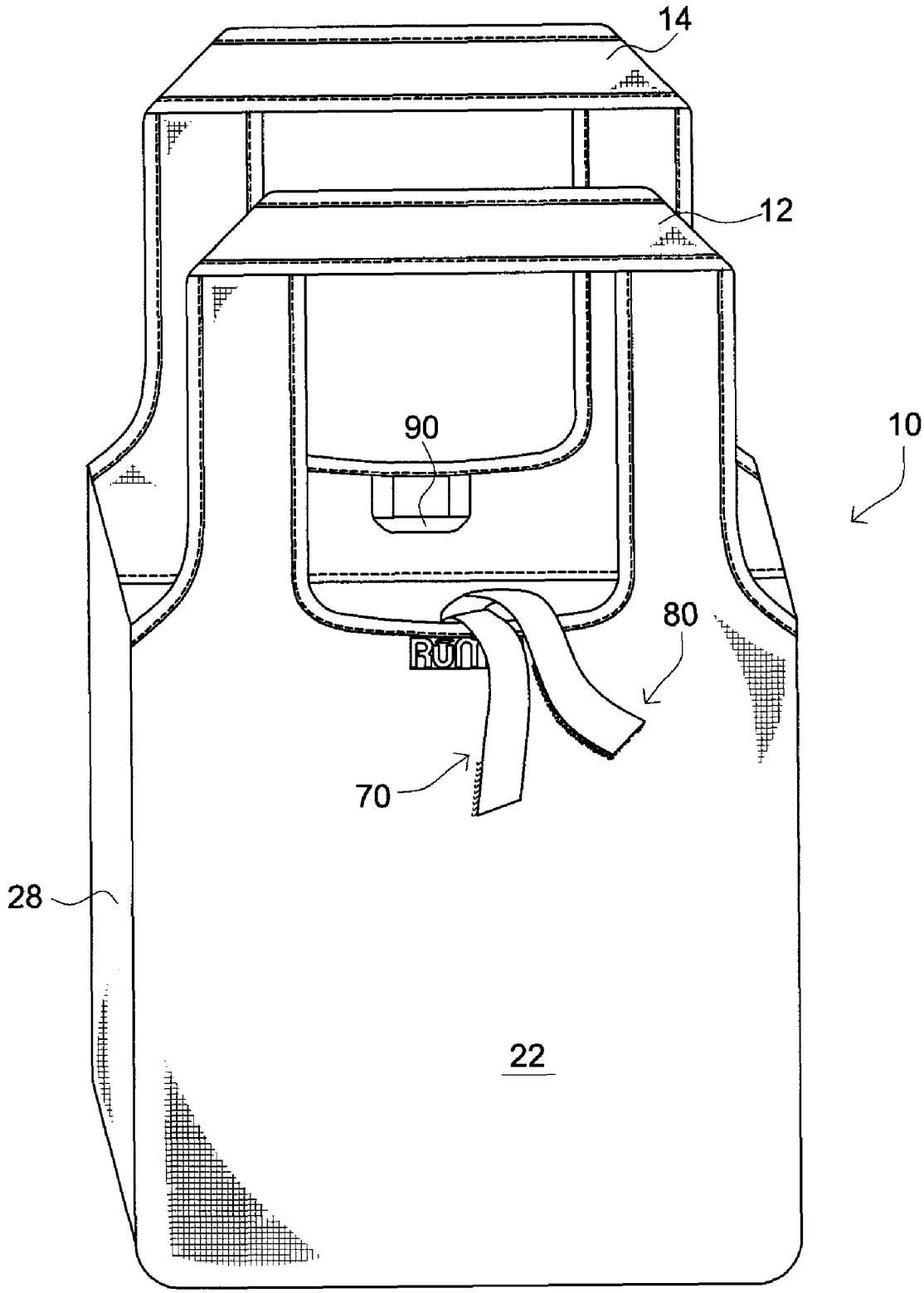
FIG. 1 is a first perspective view of an embodiment of a reusable bag incorporating a fastening system of the present invention.

Embodiments of the present invention comprise reusable bags with fastening systems whereby items may be secured within an interior cavity of the reusable bag, items may be attached to the reusable bag, and the reusable bag may folded and/or rolled and secured by itself or stacked and secured along with one or more additional bags. A reusable bag typically includes a first loop handle, a second loop handle, and at least one panel comprising a single thin flexible sheet material or a plurality of such pieces.

Embodiments of the reusable bag comprise panels made from distinct pieces of material or a portion of a single piece of material. The materials may comprise of any number of materials such as, but not limited to, a woven fabric or a non-woven fabric. The materials used to make embodiments of the reusable bag are typically adapted to receive a variety of colors and patterns providing style to reusable bags. Embodiments of the reusable bag come in a variety of sizes, such as mini-sizes that make it convenient for a user to place one or more folded and wrapped reusable bags in the user's purse, pocket, or glove compartment. Hence, environmentally conscience individuals can conveniently take one or more reusable bags with them when shopping or during other activities which traditionally utilize paper or plastic disposable bags. Furthermore, embodiments of the reusable bag comprise replacements for traditional bags such as, but not limited to, gym bags, sport bags, diaper bags, gift bags, aprés-ski bags, overnight bags, laundry bags, and beach bags.

To address the needs of simplicity in design and structure with a plurality of functional requirements, a fastening system is employed in one embodiment. Because a no-waste philosophy is employed in constructing embodiments of the reusable bags, the fastening system typically provides a plurality of functional uses. One or more straps comprise the fastening system according to the present invention. A first strap and a second strap typically comprise the fastening system. A looped third strap is also engaged in various uses of the fastening system. Typically, the first and second straps hang generally in an overlapping manner from a first top edge formed generally where the first loop handle intersects the first panel. A first strap proximal end of the first strap is coupled to the first top edge. Extending from the first strap proximal end to a first strap distal end, a front surface of the first strap typically comprises at least two portions. A first fastener portion extends generally toward the first strap distal end.

A second strap proximal end of the second strap is also coupled to the first top edge. The second strap proximal end is located generally on top of and coupled to the same portion of the first top edge as the first strap proximal end. Furthermore, the first strap proximal end and the second strap proximal end are located in the general center of the reusable bag along the first top edge. Similar to the first straps, extending from the second strap proximal end to a second strap distal end, a front surface of the second strap typically comprises at least two portions. A second fastener portion of the front surface extends generally toward the second strap distal end. The first fastener portion of the first strap may be removably and mateably coupled to the second fastener portion of the second strap.

Numerous variations are contemplated relating to the fastening system aspect of the present invention. The reusable bag may further include a pocket. The pocket is typically located in the general horizontal center of the reusable bag and vertically positioned such that its open top end may receive at least a portion of the first and second straps. Hence, the first strap and the second strap may be placed inside the pocket to keep them out of the way while a user actively places items into and removes items from the reusable bag.

An interior cavity is formed by a plurality of internal surfaces of the panels comprising the reusable bag. The first strap and the second strap may each by looped through a looped third strap on the opposing panel to aid in securing item placed and carried in the reusable bag. By securing the first and second panels in this manner, the structural integrity of the reusable bag is significantly increased making it more like to be adopted by environmentally conscience, but pragmatic, consumers. Further, various item may be secured using the fastening system of the reusable bag such as attaching a pouch to the reusable bag.

A plurality of reusable bags are folded and secured by the fastening system of the reusable bag. Additionally, when the reusable bag is not folded, but rather in use, the first strap and the second strap may generally wrapped around a portion of an object such as a bottle to secure that object while carrying and using the reusable bag.

A exemplary method pertaining to the reusable bag method comprises folding and/or rolling the reusable bag along with folding and/or rolling one or more additional bags, stacking the reusable bag and one or more additional bags on top of each other, wrapping the first and second straps of the folded/rolled reusable bag around itself and the one or more additional bags, and securing the first and second fastener portions together.

Terminology:

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, tense or any singular or plural variations of the defined word or phrase.

The term "or" as used in this specification and the appended claims is not meant to be exclusive rather the term is inclusive meaning: either or both.

References in the specification to "one embodiment", "an embodiment", "a preferred embodiment", "an alternative embodiment", "a variation", "one variation", and similar phrases mean that a particular feature, structure, or characteristic described in connection with the embodiment is included in at least an embodiment of the invention. The appearances of phrases like "in one embodiment", "in an embodiment", or "in a variation" in various places in the specification are not necessarily all meant to refer to the same embodiment or variation.

The term "integrate" or "integrated" as used in this specification and the appended claims refers to a blending, uniting, or incorporation of the identified elements, components or objects into a unified whole.

Directional and/or relationary terms such as, but not limited to, "left," "right," "top," "bottom," "vertical," "horizontal," "back," "front" and "lateral" are relative to each other and are dependent on the specific orientation of an applicable element or article, and are used accordingly to aid in the description of the various embodiments and are not necessarily intended to be construed as limiting.

As applicable, the terms "about" or "generally" as used herein unless otherwise indicated means a margin of +−20%. Also, as applicable, the term "substantially" as used herein unless otherwise indicated means a margin of +−10%. It is to be appreciated that not all uses of the above terms are quantifiable such that the referenced ranges can be applied.

One Embodiment of a Reusable Bag

Referring to FIG. 1, one embodiment of a reusable bag incorporating a fastening system according to the present invention is shown. A reusable bag 10 typically includes a first loop handle 12, a second loop handle 14, and at least one panel comprising a single thin flexible sheet material or a plurality of such pieces. Panels as used herein may refer to distinct pieces of material or a portion of a single piece of material. The materials used for the panels may comprise of any number of materials such as, but not limited to, a woven fabric or a non-woven fabric capable of being machine washable. At least one embodiment is constructed from flexible, reinforced 100% polyester approximately 180 denier thick. Further, variations of one embodiment are constructed from films and fabrics comprising polyethylene terephthalate, polyfins, and/or fluorinated polymers, for example. Additionally, in one embodiment, panels may comprise a fine weave of reinforced 100% polyester. It should be noted, however, that the principles encompassed by the present invention are not limited to any specific type of fabric, material, and/or construction thereof.

A first exterior surface 22 of a first panel can be seen from the perspective view of FIG. 1. As further illustrated, one or more edges comprise the first panel. Typically, the one or more edges are double-bound to provide greater structural integrity and resistance to water or liquid leakage or infiltration. The reusable bag 10 may also comprise one or more side panels. A first exterior side surface 28 of a first side panel is shown. As illustrated in FIG. 1, the first loop handle 12 is integral with the first panel. It is pertinent to note that the handles of the reusable bag 10 are typically loop handles as a part of a unitary panel, but may also comprise any type of a number of handles, loop handles or otherwise, to secure the reusable bag 10 and its contents, such as, but not limited to, thin strap and rope handles. However, it is to be appreciated that the far extending and generally large and wide loop handles as illustrated provide for ease of carrying and greater load bearing of the reusable bag 10. Additionally, a fastening system is shown in FIG. 1. The fastening system of the present invention includes at least one of a first strap 80, a second strap 70, and a looped third strap 90.

Figure 2:
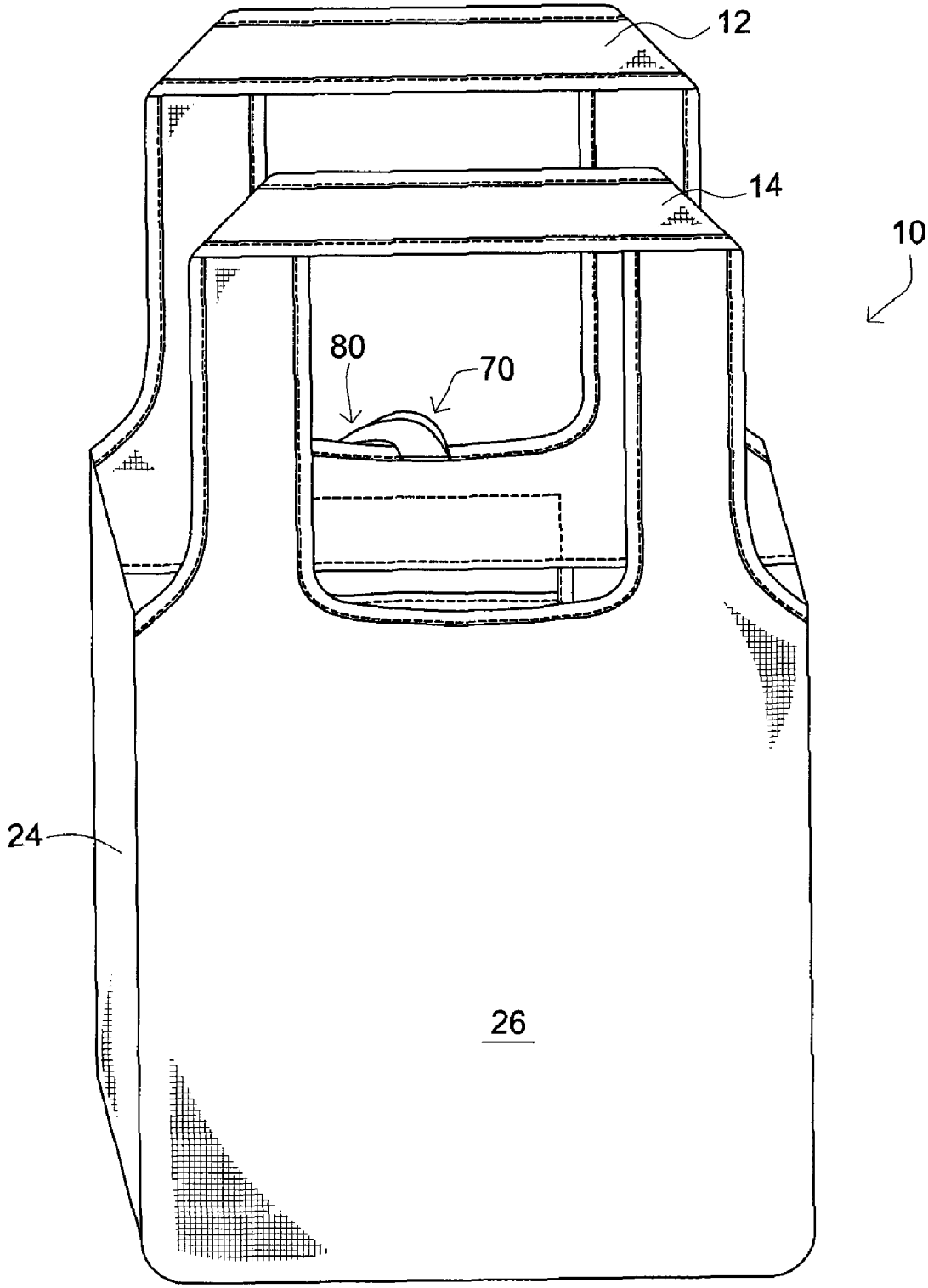
FIG. 2 is a second perspective view of an embodiment of the reusable bag incorporating the fastening system of the present invention.

FIG. 2 shows one embodiment of the reusable bag 10 incorporating a fastening system according to the present invention from a generally opposite view from FIG. 1. A second panel of the reusable bag 10 is shown from the perspective view in FIG. 2. A second exterior surface 26 of the second panel and a second exterior side surface 24 of a first side panel are shown. The first and second side panels are illustrated in FIG. 1 and 2 in describing one embodiment of the reusable bag 10. However, in a variation of one embodiment, side panels may be excluded and the first panel 22 and the second panel 26 may be directly coupled together along one or more edges to form the shape of the bag.

Figure 3:
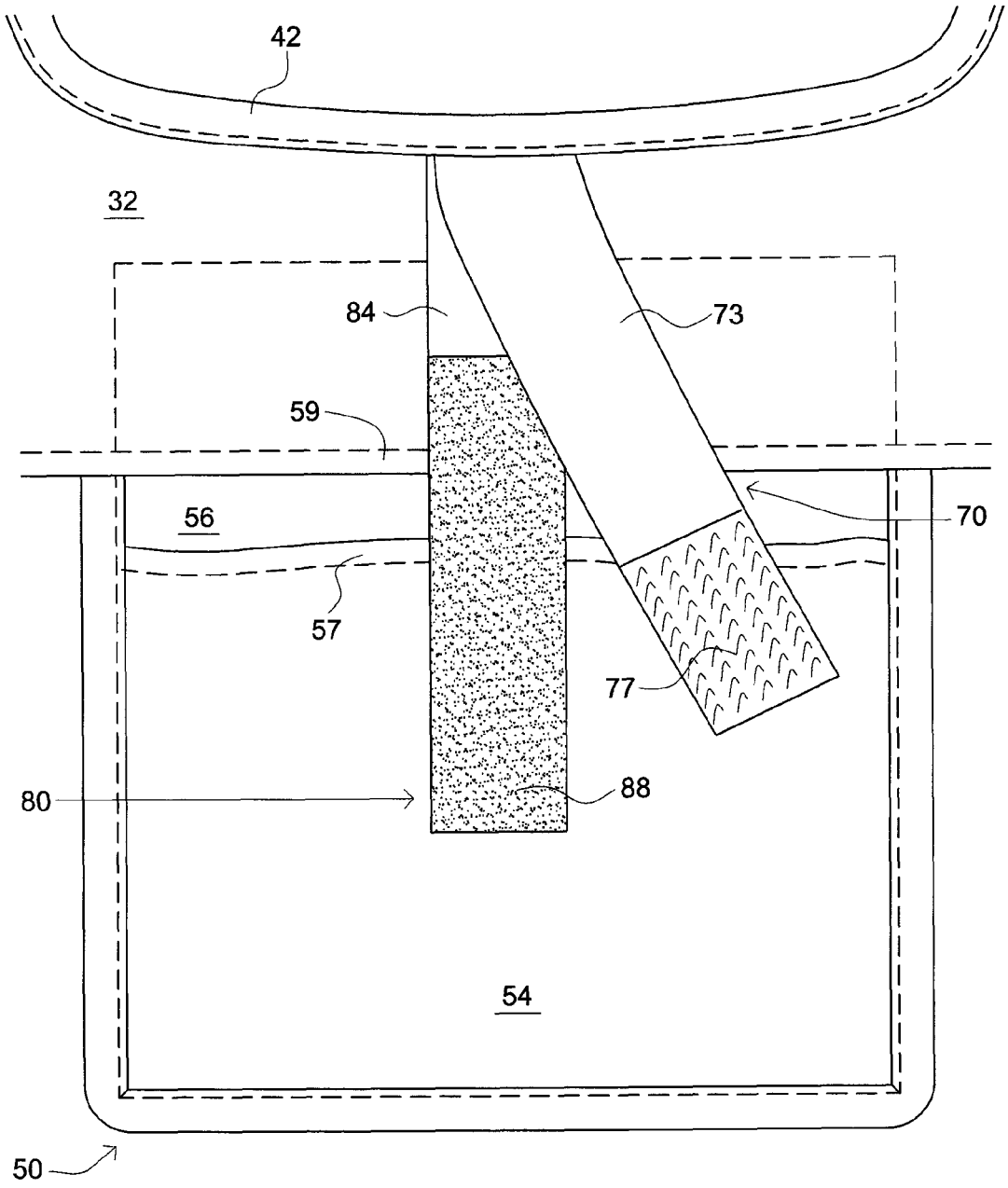
FIG. 3 shows a close-up front view of the fastening system and a pocket according to an embodiment of the present invention.

Now referring to FIG. 3, a close-up view from inside of the reusable bag 10 is shown highlighting the first and second straps. A first interior surface 32 of the first panel serves as the backdrop of the various elements described in FIG. 3. One or more straps comprise the fastening system according to the present invention. As illustrated FIG. 3, two straps typically comprise the main components of the fastening system. Portions of the first strap 80 and the second strap 70 are described to aid in understanding the operation of the fastening system hereinafter. Typically, the first and second straps would hang generally in an overlapping manner. However, for descriptive purpose regarding the picture, the first strap 70 has been moved slightly to the right to observe portions of the second strap 80.

A first top edge 42 is formed generally where the first loop handle 12 intersects the first panel. Not shown in this view, but a second top edge is formed generally where the second loop handle 14 intersects the second panel. Referring momentarily back to FIG. 1, the second top edge can be seen along with the looped third strap 90. A first strap proximal end of the first strap 80 is coupled to the first top edge 42 as depicted in FIG. 3. Extending from the first strap proximal end to a first strap distal end, a front surface of the first strap 80 typically comprises at least two portions. A first fastener portion 88 extends generally toward the first strap distal end and a first strap portion 84 of the first strap 80 that does not comprise any fastening means extends generally toward the first strap proximal end.

A second strap proximal end of the second strap 70 is also coupled to the first top edge 42. As shown in FIG. 3, the second strap proximal end is located generally on top of and coupled to the same portion of the first top edge 42 as the first strap proximal edge. Furthermore, the first strap proximal end and the second strap proximal end are located in the general center of the reusable bag 10 along the first top edge 42. Similar to the first straps, extending from the second strap proximal end to a second strap distal end, a front surface of the second strap 70 typically comprises at least two portions. A front surface of the second strap 70 comprises a second fastener portion 77 and a second strap portion 73. The second fastener portion 77 extends generally toward the second strap distal end. The second strap portion 73 does not comprise any fastening means and extends generally toward the second strap proximal end.

The first fastener portion 88 of the first strap 80 may be removably and mateably coupled to the second fastener portion 77 of the second strap 70. A Velcro®-type hook and loop fastener assembly is typically be used in the fastener portions described herein. For example, a loop portion of the Velcro®-type hook and loop fastener assembly may comprise the fastening means of the first fastener portion 88 and a loop portion may comprise the fastening means of the second fastener portion 77. One of ordinary skill in the art, however, will know and appreciate that the present invention is not limited to any specific type of fastening assembly and/or mechanism between the first and second fastener portions. Other fastening assemblies and/or mechanisms such as, but not limited to, snap fasteners, buttons with receiving loops/holes, and buckles are also contemplated. Moreover, it is pertinent to note that the fastening or removably and mateably coupling portions of the first and second straps do not come in contact with each other as they lay in their normal manner.

Numerous variations are contemplated relating to the fastening system aspect of the present invention. For instance, a single strap extending from the first top edge 42 with one of a hook and loop fastener may be removably and mateably coupled to a portion of the first exterior surface 22 of a first panel with the other of the hook and loop fastener. Additionally, the first strap 80 and the second strap 70 may be of a variety of lengths depending on specific fastening and enclosure needs. It is also contemplated that more than two straps may be used in the fastening system of the reusable bag 10. For example, a plurality of adjoining straps (with characteristics of the first strap 80 and second strap 70 described above) may extend from various points along the first top edge 42 depending on specific fastening and enclosure needs. Further, the one or more straps may attach to and extend from a plurality of places on the reusable bag 10, and is not limited to attachment along the first top edge 42.

As also shown in FIG. 3, the reusable bag 10 may further include a pocket 50. The pocket 50 typically comprises a first lining 54 and a second lining 56 coupled by one or more pocket edges. It is to be appreciated the one or more pocket edges may encircle any number of various-shaped pockets. Further, variation of the pocket may comprise one or more side pocket panels to provide a larger pocket interior cavity. The pocket 50 may be attached to the reusable bag 10 by a pocket attachment seam 59 coupling the second lining 56 to the first interior surface 32 of the first panel as depicted in FIG. 3. A top pocket seam 57 runs along the top edge of the first lining 54. Hence, an open top end of the pocket 50 exists between the top pocket seam 57 and the inner surface of the second lining 56.

The pocket 50 is typically located in the general horizontal center of the reusable bag 10 and vertically positioned such that its open top end may receive at least a portion of the first and second straps. For example, the first strap 80 and the second strap 70 may be placed inside the pocket to keep them out of the way while a user actively places items into and removes items from the reusable bag 10. In addition the pocket 50 may serve as convenient place to put and store purchase receipts when the user has a single reusable bag in which to place goods from a plurality of stores, such as when shopping at a mall or open market.

Figure 4A:
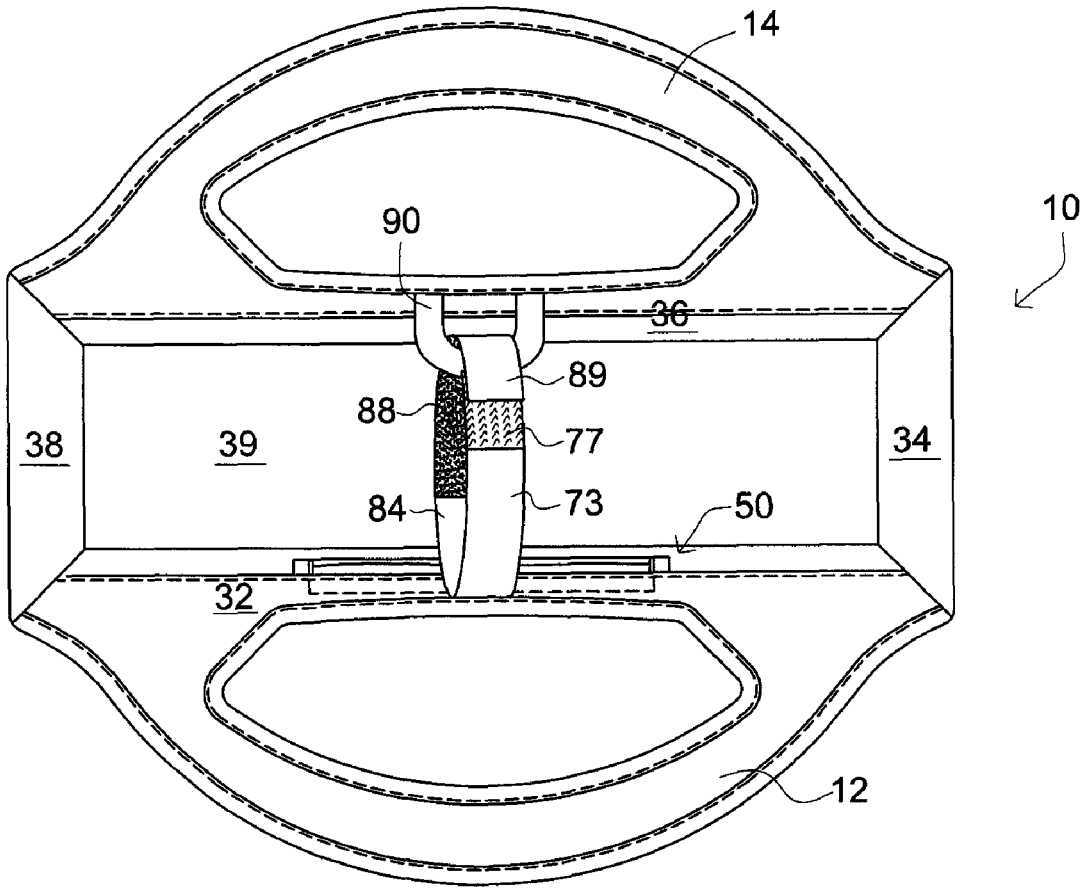
FIGS. 4A and 4B show overhead perspective views of functions of the reusable bag's fastening system according to an embodiment of the present invention.

Now referring to FIG. 4A, an interior cavity of the reusable bag 10 can be seen in operation with the fastening system. The interior cavity is formed by a plurality of internal surfaces of the panels comprising the reusable bag 10. In one embodiment, the internal cavity is formed by the first interior surface 32 of the first panel on which the pocket 50 is located, a second interior surface 36 of the second panel, a first interior side surface 38 of the first side panel, and a second interior side surface 34 of the second side panel; and a third interior side surface 39 (or bottom in one embodiment) of a third side panel. In a variation of one embodiment, a single side panel may be used wherein the first interior side surface 38, the second interior side surface 34, and the third interior side surface 39 are surfaces of the single side panel.

A use of the fastening system can be observed in FIG. 4A, the first strap 80 and the second strap 70 are each looped through the looped third strap 90. The looped third strap 90 is typically located in the general center of the reusable bag 10 along the second top edge. Hence, the looped third strap 90 is generally located on the second panel 36 across from the point where the proximal ends of the first and second straps are coupled to the first panel 32. The space between the second panel 36 and where a first end and a second end of the looped third strap 90 are coupled to the second panel along the second top edge provides the place in which the first and second straps are to be looped. After looping one or both of the first and second straps through the looped third strap 90, the first strap 80 may be removably and mateably coupled to the second strap 70 by fastening the first fastener portion 88 to the second fastener portion 77. When securely fastened, a back surface 89 of the first strap 80 may be seen as illustrated in FIG. 4A.

By fastening the opposing panels and top edges thereof in the this manner, larger and heavier items may be placed in the reusable bag 10 with greater protection from the possibility of the items falling out of the opening of the reusable bag 10 either when the user accidentally releases one of the two loop handles or otherwise. Furthermore, as alluded to previously, larger reusable bag with a wide top opening may employ a plurality of adjoining straps extending from various points along the first top edge 42 to be looped through a plurality of corresponding looped straps located on the second top edge.

Figure 4B:
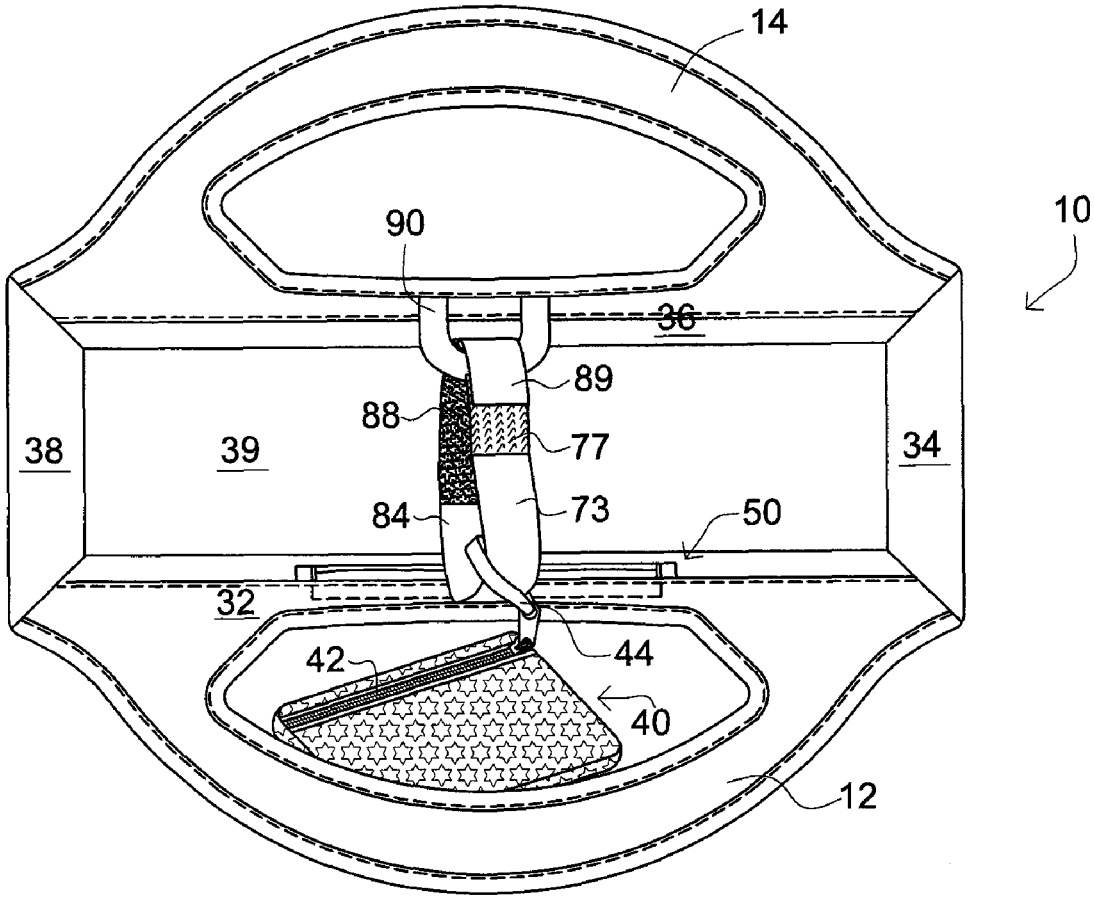

FIG. 4B provides a similar overhead perspective view as FIG. 4A. The way in which various item may be secured using the fastening system of the reusable bag 10 is illustrated in FIG. 4B. A pouch 40 may be attached to the reusable bag 10 by threading the second strap 70 through an attachment loop 44 coupled to an external surface 42 of the pouch 40. As implied from FIG. 4B, the pouch 40 would be attached by threading the second strap 70 through the attachment loop 44 removable coupling the second strap 70 to the first strap 80 as described above. Furthermore, when attaching items, such as the pouch 50, the first and second straps may or may not be looped through the looped third strap 90. It is pertinent to note that the pouch 40 may itself be a type of reusable bag. Additionally, a plurality of items that contain loops of some fashion through which either the first or second straps may be threaded, such as but not limited to keys chains, cards and identification badges with elongated holes punched therein, may be attached to the reusable bag 10 in the manner described above.

Figure 5:
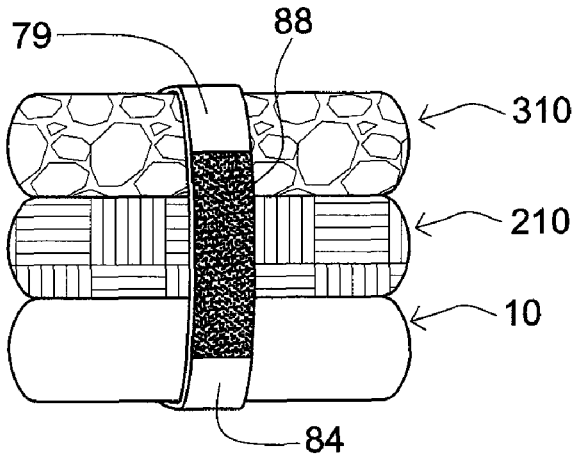
FIG. 5 shows a front view of a plurality of reusable bags wrapped and secured according to an embodiment of the present invention.

Referring now to FIG. 5, a plurality of reusable bags folded and secured by the fastening system of the reusable bag 10 as the first in the plurality of reusable bags is illustrated. After folding and stacking the plurality of reusable bags, a process that will be described later in the specification, the fastening system of bag 10 may be used to secure them. The first strap 80 is brought around the around the outside of the stacked plurality of reusable bags in one direction and second strap 70 is brought around the around the outside of the stacked plurality of reusable bags in another direction substantially opposite. The first and second straps meet at the top of the last bag in the plurality, reusable bag 310, and overlap. Next, the first strap 80 may be removably and mateably coupled to the second strap 70 by fastening the first fastener portion 88 to the second fastener portion 77. When securely fastening the plurality of reusable bags in this manner, a back surface 79 of the second strap 70 may be seen as illustrated in FIG. 5.

In variations of the reusable bag 10, a mini-version may comprise dimensions of 11 inches by 11 inches by 4 inches with 8 inch loop handles whereby each mini-version may hold up to 50 pounds and three bags may roll up into an area of 4 inches by 2.5 inches by 2 inches. Standard sizes of embodiments of the reusable bag 10 may comprise dimensions of 15.5 inches by 15.5 inches by 4 inches with loop handles 11.5 inches long. Furthermore, standard-sized reusable bags can typically hold up to 50 pounds each and three standard-sized reusable bags can roll up to an area 6 inches by 2 inches by 3 inches.

Furthermore, as previously described, the length of the first and second straps may be varied. Hence, it is to be appreciated that the first and second straps may comprise a variety of lengths and thereby hold a larger plurality of reusable bags. For example, if it is desirable to have five or even ten reusable bags stacked and secured, the length of the first strap 80 and the second strap 70 may be may be much longer than the length required to hold and fasten the three reusable bags shown in FIG. 5. Additionally, the space between the third reusable bag 310 and the first and second straps of reusable bag 10 may be used to chain a plurality of additional reusable bags either individually or stacked in groups.

Figure 6:
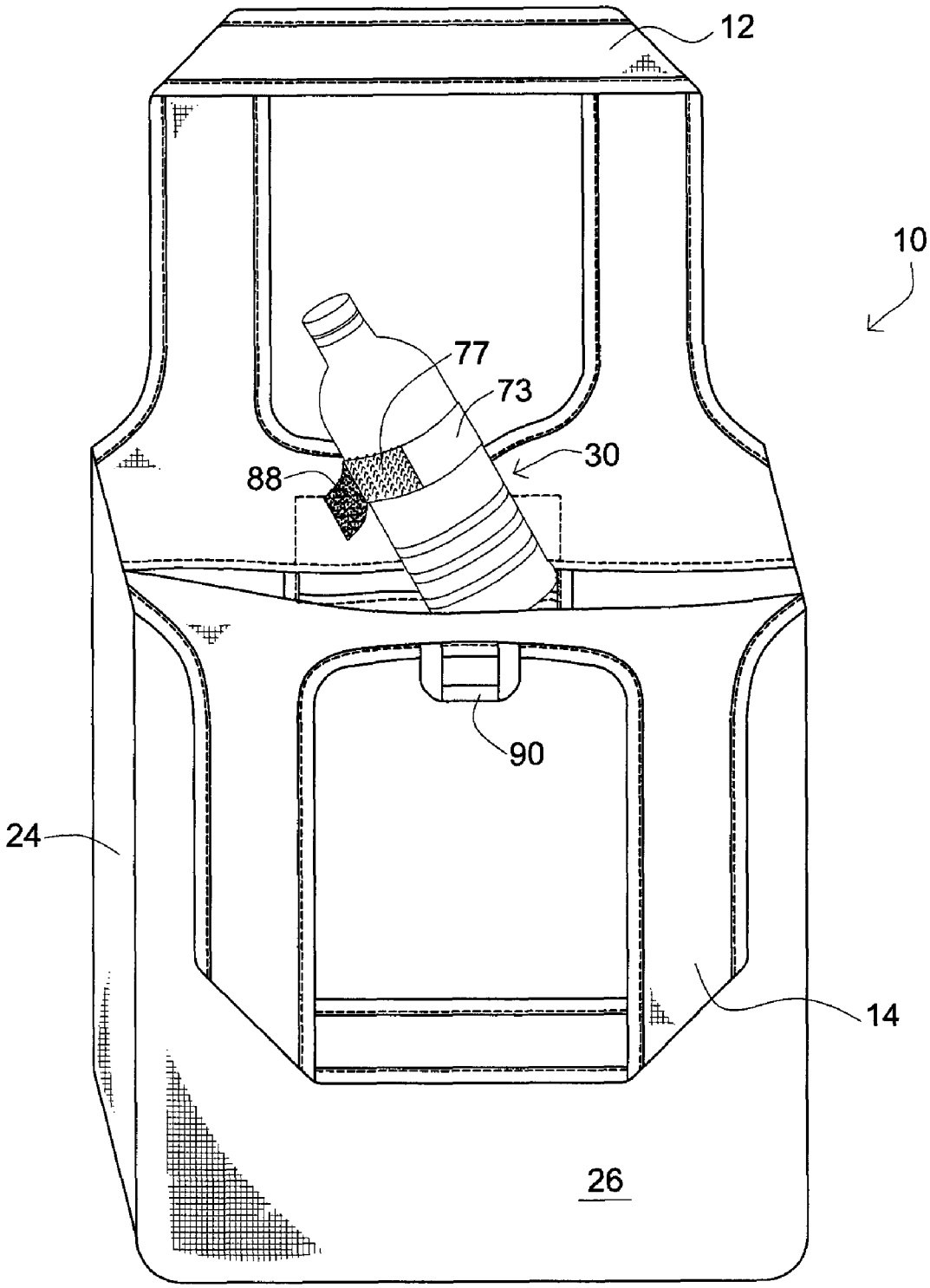
FIG. 6 is a perspective view of an embodiment of the reusable bag incorporating the fastening system of the present invention to secure an object.

FIG. 6 is a perspective view of the reusable bag similar to the view in FIG. 2 with the exception that the second loop handle 14 is lowered to more clearly expose the interior cavity. A bottle 30 is secured by the fastening system in this illustration. The first strap 80 and the second strap 70 are generally wrapped around a portion of the bottle 30. The first strap 80 is then removably and mateably coupled to the second strap 70 by fastening the first fastener portion 88 to the second fastener portion 77. Depending on the size of the bottle or other object secured, a segment of the first fastener portion 88 toward the first distal end may be exposed as illustrated in FIG. 6 even after the object has been secured by the fastening system. Any number of bottles or objects may be fastened by the manner described above. For instance, when the reusable bag 10 is used as a diaper bag, the fastening system may secure a baby bottle.

As can be deduced from the present invention, the positioning to the first and second straps enables multiple useful and novel functions of the reusable bag 10 as described throughout the specification.

One Method Pertaining to the Reusable Bag

Figure 7:
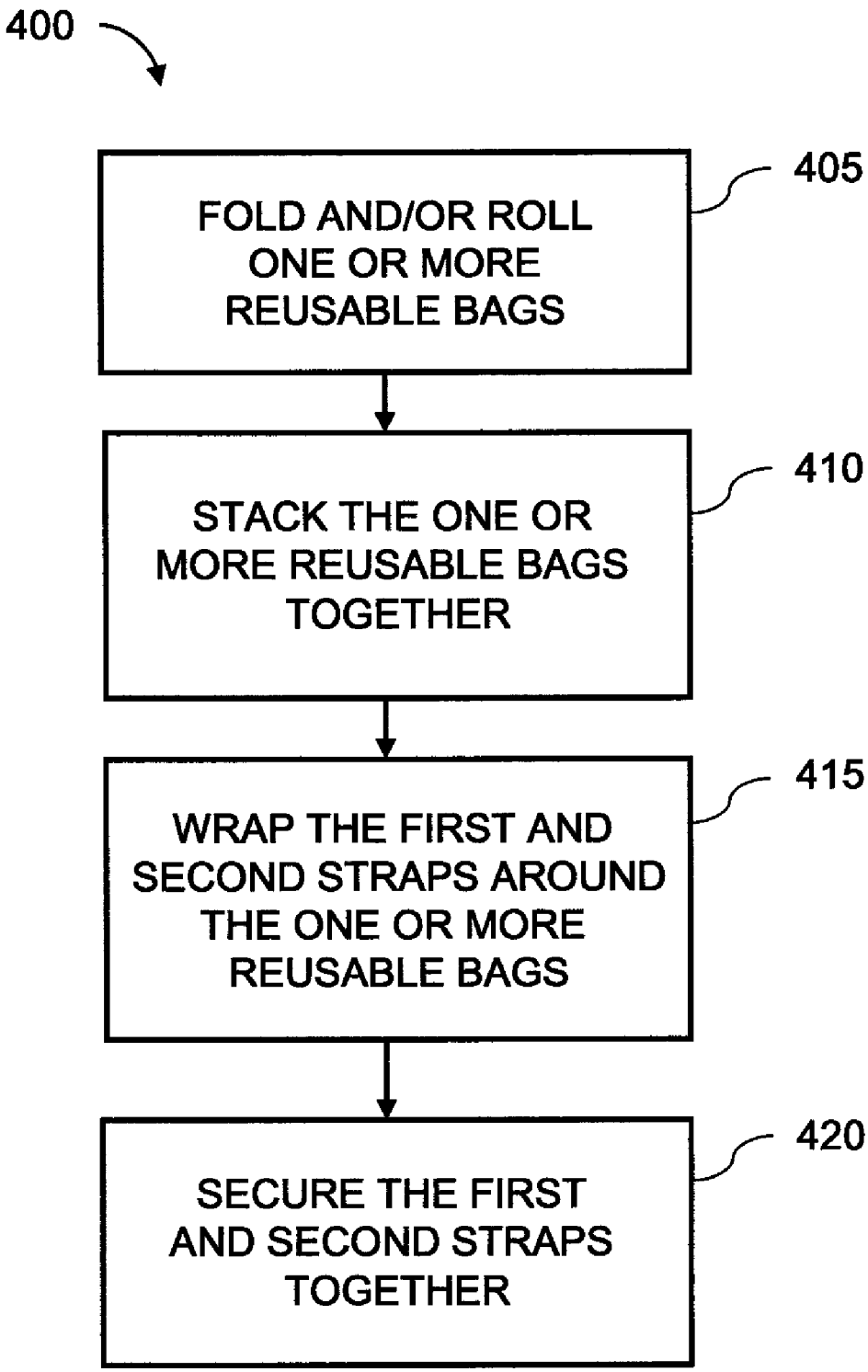
FIG. 7 is a flow chart illustrating a method pertaining to one or more reusable bags according to an embodiment of the present invention.

FIG. 7 is a flow chart illustrating a method pertaining to the reusable bag 10. A first operation 405 of the method comprises folding and/or rolling the reusable bag 10 with the first strap 80 and the second strap 70 exposed and assessable for use later in the method along with folding and/or rolling one or more additional bags. It is to be appreciated the reusable bag 10 and one or more other bags may be folded in any number of ways, however, an exemplary method is described herein.

The user typically begins by first laying the reusable bag 10 on a folding surface. Referring back to FIGS. 1 and 2, the second exterior surface 26 of the second panel along with the second loop handle 14 is placed facing or touching the folding surface whereby the first exterior surface 22 of the first panel along with the first loop handle 12 is facing the user. Any portion of the one or more side panels may be tucked toward the interior cavity so the one or more edges of the first panel comprise the boundary of the reusable bag 10 to be folded. The substantial square or rectangular shape of the panels in one embodiment allow for easy folding and staking in accordance with the present invention. Next, the first and second loop handles are folded generally along the first and second top edges whereby the first loop handle 12 (and possibly the top portion of the second loop handle 14 if it is folded in an overlapping manner with the first loop handle 12) is pressed against the first exterior surface 22. Next, if the first and second straps have not been removed from the interior cavity, that step should be performed before proceeding further.

Next, a left third portion of the reusable bag 10 is folded toward the center along a vertical axis whereby the second exterior surface 26 will be seen from the user's perspective. Then, a right third portion of the reusable bag 10 is folded toward the center along a vertical axis whereby the left third portion will be substantially covered by the right side portion exposing its second exterior surface 26. Now with a thicker center third portion of the reusable bag 10 can be easily folded and/or rolled from the bottom portion of the reusable bag toward the first top edges for where the first and second straps are extended.

A second reusable bag 210 and a third reusable bag 310 may be folded in a similarly manner as described above with respect to the reusable bag 10, except without concern for their particular first and second straps.

Next as shown in block 410, a second operation of the method comprises stacking the reusable bag 10 and one or more additional bags on top of each other. Once the one or more additional bags have been folded, the one or more additional bags may be stacked with the reusable bag 10 as the first (or on the bottom of the stack). For example, referring back to FIG. 5, the second reusable bag 210 is placed on top of the reusable bag 10 and the third reusable bag 310 is placed on top of the second reusable bag 210. As would be obvious from this description, further additional reusable bags may be stacked in this manner. It is also pertinent to note that in some instances, no bags will be stacked and this stacking operation may be essentially omitted. Such would be the situation when the reusable bag 10 was the only reusable bag to be wrapped and secured pursuant to a variation of the method thereof.

A third operation as illustrated in block 415 comprises wrapping the first and second straps of the folded/rolled reusable bag 10 around itself and the one or more additional bags, such as reusable bag 210 and reusable bag 310. The first and second straps meet at the top of the last bag of the one or more additional bags, reusable bag 310 as depicted in FIG. 5, and their distal ends overlap.

Next as show in block 420, a fourth operation of the method is performed. The fourth operation comprises securing the first and second fastener portions together. To secure the first and second fastener portions together thereby securing the one or more bags along with the reusable bag 10, the first strap 80 is removably and mateably coupled to the second strap 70 by fastening the first fastener portion 88 to the second fastener portion 77.

Alternative Embodiments and Variations

The embodiments of the reusable bag and variations thereof, illustrated in the accompanying figures and described above, are merely exemplary and are not meant to limit the scope of the present invention. It is to be appreciated that numerous other variations to the present invention have been contemplated as would be obvious to one of ordinary skill in the art given the benefit of this disclosure. All variations of the present invention that read upon the claims are intended and contemplated to be within the scope of the present invention.

Variations of reusable bags may comprise one or more sealable pockets. Additionally, some embodiments of reusable bags include protective liners and/or comprise compartments to hold, carry, and protect various items. For instance, a cushioned laptop computer compartment may be included along one of the interior surfaces of the interior cavity of the reusable bag. In some embodiments, protective liners and/or compartments may be relatively impermeable to water or completely impermeable to water or liquid in which to store valuables that would be harmed by such contact with water.

Furthermore, the entire construction of reusable bags may be comprised of materials completely impermeable to water or liquid. In further variations thereof, the reusable bag may be comprised of a single panel of material impermeable to water or liquid to avoid any potential leakage from coupled edges. In this manner, reusable bags may be used to carry potentially messy grocery items such as meats and milk without concern that carrying these messy grocery items in a reusable bag may cause spillage into the user's car or elsewhere that would have been avoided had the user used a plastic bag instead of a reusable bag permeable to water and liquid.

Additionally, some embodiments of reusable bags comprise produce bags, shoe bags, garment bags, and dry cleaning bags utilizing the fastening system and methods comprising folding and/or rolling, stacking, wrapping, and securing described herein.

The invention claimed is:

1. A reusable bag comprising a first panel having a first exterior surface, a first interior surface, and one or more first edges including a first top edge, the first panel being comprised of a thin flexible sheet material;

a second panel having a second exterior surface and a second interior surface, and one or more second edges including a second top edge, the second panel comprised of the thin flexible sheet material, the second panel being coupled with the first panel to form an interior cavity with an open end proximate the respective first and second top edges;

first and second loop handles coupled with and extending from the first and second panels respectively proximate the respective first and second top edge;

a first strap having a first strap proximal end and a first strap distal end, the first strap proximal end being attached coupled the first top edge generally proximate a center thereof, at least a first fastener portion of the first strap comprising one of a hook material and a loop material, the first strap extending generally downwardly from the first strap proximal end into the interior cavity and terminating at the first strap distal end; and a second strap having a second strap proximal end and a second strap distal end, the second strap proximal end also being coupled with the first top edge generally proximate the center thereof, at least a second fastener portion of the second strap comprising another of the hook material and the loop material adapted to mateably receive the one of the hook material and the loop material of the first strap, the second strap also extending generally downwardly from the second strap proximal end into the interior cavity and terminating at the second strap distal end.

2. The reusable bag of claim 1, wherein the thin flexible sheet material comprises a woven or non-woven fabric.

3. The reusable bag of claim 1, wherein the first panel is coupled with the second panel by one or more side panels, the one or more side panels being comprised the thin flexible sheet material.

4. The reusable bag of claim 1, wherein (i) the first loop handle and the first panel are unitary, and (ii) the second loop handle and the second panel are unitary.

5. The reusable bag of claim 1, further comprising a pocket having an open top end, the pocket being located adjacent the first interior surface and extending downwardly into the interior cavity from the open top end, the open top end being located generally near the center of the first top edge and being adapted to receive a portion of the first and second straps respectively including the first and second distal ends therein.

6. The reusable bag of claim 1, further comprising a looped third strap having left and right ends, each of the left and right ends being coupled with the second top edge proximate a center thereof on the second interior surface, a loop formed by the third strap being sufficient in size to receive one or both of the first and second straps therethrough.

7. The reusable bag of claim 1, wherein the first and second proximal ends of the respective first and second straps are coupled to the first top edge at a substantially similar location and hang downwardly therefrom substantially adjacent to each other with at least a substantial portion of a back surface of second strap directly facing a front surface of the first strap, wherein the first fastener portion and the second fastener portion are located on the respective first and second straps such that neither fastener portion faces the other.

8. The reusable bag of claim 7, wherein the first fastener portion is located on a front surface of the first strap and the second fastener portion is located on the front portion of the second strap.

9. The reusable bag of claim 8, wherein the first fastener portion comprises a loop material and the second fastener portion comprises a hook material.

10. The reusable bag of claim 1, wherein at least one of the first and second strap is received through the looped third strap with the respective distal ends over lapping and the first and second fastener portions being mateably coupled.

11. A combination comprising the reusable bag of claim 1 and a bottle, the first and second straps being wrapped around the bottle with the respective distal ends over lapping and the first and second fastener portions being mateably coupled.

12. A combination comprising the reusable bag of claim 1 and one or more additional bags, each of the additional bags comprising (i) a first panel having a first exterior surface, a first interior surface, and one or more first edges including a first top edge, the first panel being comprised of a thin flexible sheet material, (ii) a second panel a second exterior surface and a second interior surface, and one or more second edges including a second top edge, the second panel comprising a second piece of the thin flexible sheet material, the second panel being coupled with the first panel to form an interior cavity with an open end proximate the respective first and second top edges and (iii) first and second loop handles coupled with and extending from the first and second panels respectively proximate the respective first and second top edge wherein:

the reusable bag of claim 1 and the one or more additional bags are each compactly folded; the first and second straps extend from the first top edge proximate their respective proximal ends and extend around the one or more additional bags with the respective distal ends over lapping and the first and second fastener portions being mateably coupled whereby the bag of claim 1 and the one or more additional bags are secured together.

13. The combination of claim 12 wherein the one or more additional reusable bags each include:

a first strap having a first strap proximal end and a first strap distal end, the first strap proximal end being attached coupled the first top edge generally proximate a center thereof, at least a first fastener portion of the first strap comprising one of a hook material and a loop material, the first strap extending generally downwardly from the first strap proximal end into the interior cavity and terminating at the first strap distal end; and a second strap having a second strap proximal end and a second strap distal end, the second strap proximal end also being coupled with the first top edge generally proximate the center thereof, at least a second fastener portion of the second strap comprising another of the hook material and the loop material adapted to mateably receive the one of the hook material and the loop material of the first strap, the second strap also extending generally downwardly from the second strap proximal end into the interior cavity and terminating at the second strap distal end.

14. The combination of claim 12, wherein the one or more additional bags comprises two or more bags.

15. The combination of claim 12, wherein the thin flexible sheet material comprises a fabric.

16. A reusable bag comprising a first panel having a first exterior surface, a first interior surface, a first top edge, a first left edge, a first right edge and a first bottom edge, the first panel being comprised of a thin flexible fabric, the first panel including a first handle loop extending from the first top edge;

a second panel a second exterior surface and a second interior surface, a second interior surface, and a second top edge, a second left edge, a second right edge and a second bottom edge, the second panel being comprised of the thin flexible fabric the second panel including a second handle loop extending from the second top edge;

a left side panel comprised of a thin flexible fabric;

a right side panel comprised of a thin flexible fabric;

a bottom side panel comprised of a thin flexible fabric, wherein the first and second panels are coupled together at their respective edges by way of intervening left side, right side and bottom side panels;

a first strap having a first strap proximal end and a first strap distal end, the first strap proximal end being attached coupled the first top edge generally proximate a center thereof, at least a first fastener portion of the first strap comprising a loop material located on a front side of the first strap, the first strap extending generally downwardly from the first strap proximal end into the interior cavity and terminating at the first strap distal end;

a second strap having a second strap proximal end and a second strap distal end, the second strap proximal end also being coupled with the first top edge substantially on top of the first strap, at least a second fastener portion of the second strap comprising a hook material located on the front side of the second strap, the hook material adapted to mateably receive the loop material of the first strap, the second strap also extending generally downwardly from the second strap proximal end into the interior cavity and terminating at the second strap distal end;

a pocket having an open top end, the pocket being located adjacent the first interior surface and extending downwardly into the interior cavity from the open top end, the open top end being located generally near the center of the first top edge and being adapted to receive a portion of the first and second straps respectively including the first and second distal ends therein; and a looped third strap having left and right ends, each of the left and right ends being coupled with the second top edge proximate a center thereof on the second interior surface, wherein at least one of the first and second strap is adapted to be received through the looped third strap with the respective distal ends over lapping and the first and second fastener portions being mateably coupled.

* * * * *